US012758857B2

(12) United States Patent
Lawless et al.

(10) Patent No.: US 12,758,857 B2
(45) Date of Patent: Oct. 13, 2026

(54) TURTLE HATCH GAME

(71) Applicant: LOVEVERY, INC., Boise, ID (US)

(72) Inventors: Stephen Blaise Lawless, Boise, ID (US); Amanda McKown O'Grady, Boise, ID (US)

(73) Assignee: Lovevery, Inc., Boise, ID (US)

( * ) Notice: Subject to any disclaimer, the term of this patent is extended or adjusted under 35 U.S.C. 154(b) by 355 days.

(21) Appl. No.: 18/567,070

(22) PCT Filed: Jun. 14, 2022

(86) PCT No.: PCT/US2022/072932
§ 371 (c)(1),
(2) Date: Dec. 5, 2023

(87) PCT Pub. No.: WO2022/266621
PCT Pub. Date: Dec. 22, 2022

(65) Prior Publication Data

US 2024/0261665 A1 Aug. 8, 2024

Related U.S. Application Data

(60) Provisional application No. 63/210,495, filed on Jun. 15, 2021.

(51) Int. Cl.
*A63F 3/00* (2006.01)
*A63F 9/04* (2006.01)
(Continued)

(52) U.S. Cl.
CPC ..... *A63F 3/00006* (2013.01); *A63F 9/14* (2013.01); *A63F 2009/0486* (2013.01);
(Continued)

(58) Field of Classification Search
CPC ..... A63F 3/00006; A63F 9/14; A63F 2009/0486; A63F 2011/0048; A63F 2250/0407; A63F 2250/0414
See application file for complete search history.

(56) References Cited

U.S. PATENT DOCUMENTS 2,285,737 A 6/1942 Mcleod
3,754,763 A * 8/1973 Breslow ..... A63F 3/00145 273/243
(Continued)

FOREIGN PATENT DOCUMENTS

GB 1312290 4/1973
GB 2231499 11/1990

OTHER PUBLICATIONS

Extended European Search Report in European Appln No. 22826006.3, dated Sep. 5, 2024, 6 pages.
(Continued)

*Primary Examiner* — Audrey B. Walter
(74) *Attorney, Agent, or Firm* — Fish & Richardson P.C.

(57) ABSTRACT

A multiplayer game includes a mobile playing environment defining a water reservoir and a path leading down into the reservoir, a reservoir filling container defining a volume configured to hold a quantity of water for a player to pour into the reservoir to increase a level of water within the reservoir and cause the water level to rise along the path, player tokens movable to and between various positions along the path, and a movement instructor manipulable by a player to generate an unselected movement instruction from a limited set of possible instructions including moving a token downward along the path and adding water to the reservoir.

19 Claims, 10 Drawing Sheets

(51) Int. Cl.
*A63F 9/14* (2006.01)
*A63F 11/00* (2006.01)

(52) U.S. Cl.
CPC ..... *A63F 2011/0048* (2013.01); *A63F 2250/0407* (2013.01); *A63F 2250/0414* (2013.01)

(56) References Cited

U.S. PATENT DOCUMENTS

| | | | | |
|---|---|---|---|---|
| 4,348,028 | A * | 9/1982 | Barlow | A63F 7/3622 273/287 |
| 5,855,481 | A | 1/1999 | Weichselbaum | |
| 6,412,782 | B1 * | 7/2002 | Rivet | A63F 7/045 273/459 |
| 2012/0211529 | A1 * | 8/2012 | Piazza | B67D 7/005 222/544 |

OTHER PUBLICATIONS

Brand [online], "Fluss Der Drachen," 2008, retrieved on Aug. 11, 2022, retrieved from URL<https://boardgamegeek.com/boardgame/36729/fluss-der-drachen>, 3 pages.

Hasbro [online], "Super Soaker Twister," 1995, retrieved on Aug. 11, 2022, retrieved from URL<https://boardgamegeek.com/boardgame/142576/super-soaker-twister>, 3 pages.

International Search Report and Written Opinion in International Appln. No. PCT/US2022/072932, mailed on Sep. 6, 2022, 9 pages.

Winning Moves Games [online], "Sunk!," Board Game Geek, Web Forum, 2016, retrieved Aug. 11, 2021, retrieved from URL<https://boardgamegeek.com/boardgame/217560/sunk>, 3 pages.

* cited by examiner

TURTLE HATCH GAME

CROSS-REFERENCE TO RELATED APPLICATIONS

This application is a National Stage Application under 35 U.S.C. § 371 and claims the benefit of International Application No. PCT/US2022/072932, filed Jun. 14, 2022, which claims priority to U.S. Provisional Patent Application Ser. No. 63/210,495 filed Jun. 15, 2021. The entire contents of the foregoing are hereby incorporated by reference.

TECHNICAL FIELD

This disclosure relates to games, and more particularly to multiplayer board games.

BACKGROUND

Children (e.g., infants and toddlers) can benefit from playing with collaborative games with no winners or losers. Such games can be designed to encourage cooperative behavior and teamwork from an early age, foster communication between players, and help reduce competitive environments and relationships that may trigger aggressive behaviors in children. Improvements in the design, configuration, and safety of such games and other games are continually sought.

SUMMARY

In general, this disclosure relates to multiplayer, games, such as cooperative games, that use water as a component of the game. The multiplayer games described herein include mobile playing environments that define a water reservoir, reservoir filling containers, and player tokens configured to float in water.

In one aspect, this disclosure relates to a multiplayer game including a mobile playing environment defining a water reservoir and a path leading down into the reservoir; a reservoir filling container defining a volume configured to hold a quantity of water for a player to pour into the reservoir to increase a level of water within the reservoir and cause the water level to rise along the path; player tokens movable to and between various positions along the path; and a movement instructor manipulable by a player to generate an unselected movement instruction from a limited set of possible instructions including moving a token downward along the path and adding water to the reservoir.

In some embodiments, the movement instructor includes a multi-faced die, with faces of the die marked to indicate movement instructions.

In some embodiments, at least one die face indicates that a player is to add water to the reservoir, and at least one other die face indicates that a player is to move a token along the path.

In some embodiments, the movement instructor includes a spinner having motion segments marked to indicate movement instructions.

In some embodiments, the path includes a series of levels separated by steps.

In some embodiments, the limited set of possible instructions includes different numbers of steps for a player to move a token down the path.

In some embodiments, the path curves around a central portion of the mobile playing environment.

In some embodiments, the central portion is adapted to hold the reservoir filling container between uses.

In some embodiments, the volume of the reservoir filling container is less than about 3% of a total volume of the reservoir.

In some embodiments, the reservoir filling container includes a ladle.

In some embodiments, the multiplayer game further includes a game termination indicator including a discrete number of game-end segments that together indicate an end of play when manipulated.

In some embodiments, the limited set of possible instructions includes manipulating a next game-end segment.

In some embodiments, the game-end segments include wedge segments that together form a circle.

In some embodiments, the game termination indicator includes a circular base that is configured to receive the game-end segments.

In some embodiments, the limited set of possible instructions include moving a game-end segment to the circular base.

In some embodiments, the multiplayer game further includes game play instructions indicating that a player may move any one of the player tokens in response to the movement instructor generating an instruction to move a token downward along the path.

In some embodiments, the multiplayer game further includes a basin defining a basin reservoir configured to hold water for the player to remove with the reservoir filling container.

In some embodiments, the basin and the mobile playing environment are nestable and include one or more alignment features configured to confirm alignment between the basin and the mobile playing environment.

In some embodiments, at least two die faces indicate the same movement instruction.

In another aspect, the present disclosure features a multiplayer game including a mobile playing environment defining a water reservoir and a path leading down into the water reservoir; a reservoir filling container defining a volume configured to hold a quantity of water for a player to pour into the water reservoir to increase a level of water within the water reservoir and cause the water level to rise along the path; player tokens movable to and between various positions along the path; a movement instructor manipulable by a player to generate an unselected movement instruction from a limited set of possible instructions including moving a token downward along the path and adding water to the water reservoir; and a basin defining a basin reservoir configured to hold water for the player to remove with the reservoir filling container, wherein the basin and the mobile playing environment are nestable and include one or more alignment features configured to confirm alignment between the basin and the mobile playing environment.

In some embodiments, the mobile playing environment and the basin define equivalent volumes.

Embodiments may provide one or more of the following advantages.

Various embodiments of the present disclosure relate to multiplayer games preferably intended for use by toddlers and/or infants of age three and under. The multiplayer games of the disclosure are therefore designed to be approved for use by children under three years of age e.g., in the United States and European Union (per the 16 Code of Federal Regulations (C.F.R.) Part 1501 and The Toy Safety Directive 2009/48/EC, respectively). For example, the multiplayer games do not have sharp edges and points that could present a hazard to the user. In another example, the multiplayer games meet hazardous substance requirements.

In some embodiments, the multiplayer games include nestable components that can facilitate storage and ease of use. In some embodiments, the multiplayer games disclosed herein feature a mobile playing environment, a basin, and a reservoir filling containers defining volumes that are optimal during play such that the average game can typically end with a water level on the mobile playing environment side no higher than about 50% to about 66% full. In some embodiments, the multiplayer games of the disclosure are cooperative games that can teach an alternative way of playing, especially for children who are mostly familiar with competitive play.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
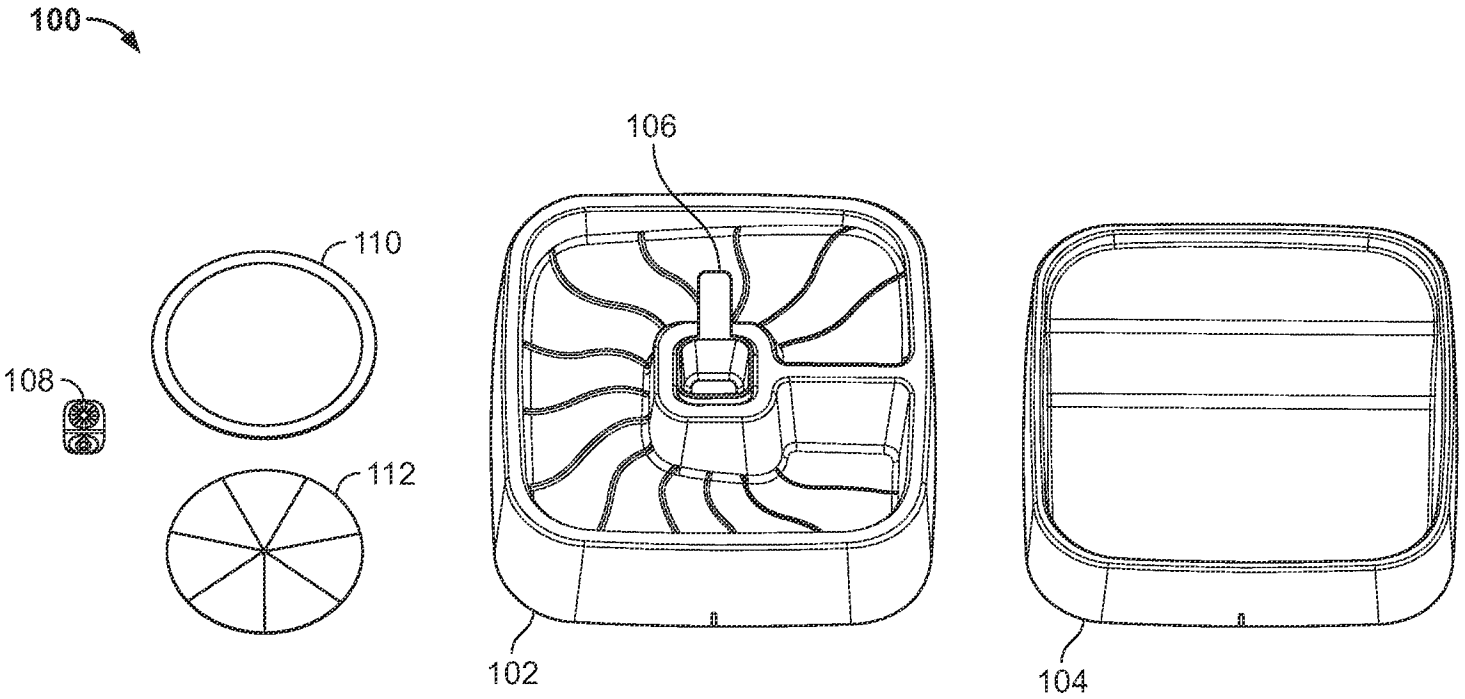
FIG. 1 is a perspective view of a multiplayer game.

FIG. 1 illustrates a multiplayer game 100 that can be played by children (e.g., toddlers) in a collaborative manner to achieve the goal of getting a player token to float in water in a mobile playing environment. The multiplayer game 100 includes a mobile playing environment 102 (e.g., a game board), a basin 104, a reservoir filling container 106, a movement instructor 108 (e.g., a die), a base 110, and a plurality of game-end segments 112.

Figure 2:
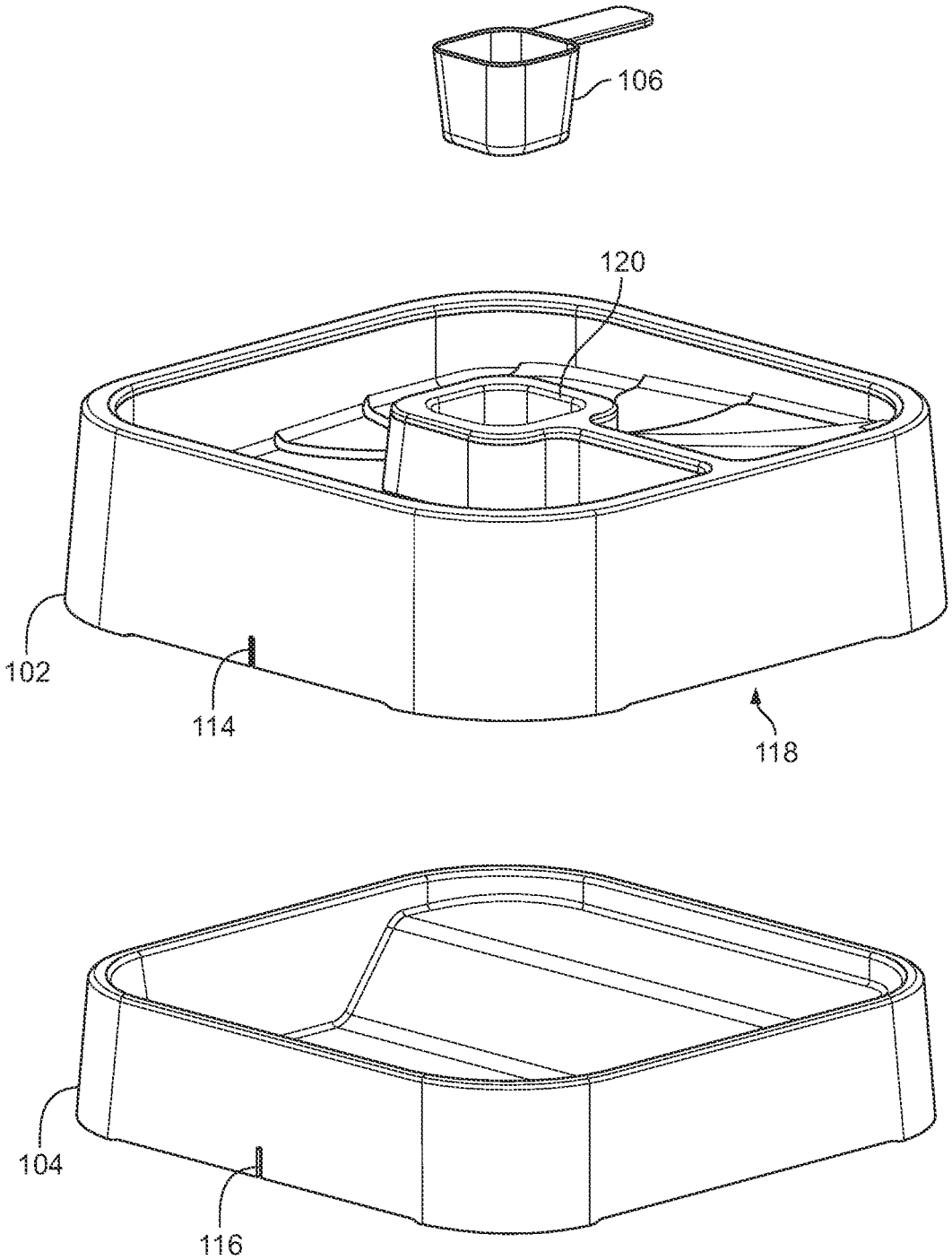
FIG. 2 is an exploded view of the multiplayer game of FIG. 1.

FIG. 2 shows an exploded view of the basin 104, the mobile playing environment 102, and the reservoir filling container 106. The mobile playing environment 102 and the basin 104 are nestable and each one includes one or more alignment features 114 that are configured to confirm alignment between the basin 104 and the mobile playing environment 102. When in use, a user (e.g., a child) can align one or more alignment features 114 of the mobile playing environment 102 with one or more features 116 of the basin 104 such that the basin 104 can be nested within the mobile playing environment 102. When the multiplayer game 100 is in a storage configuration, the basin 104 can be fitted securely inside an underside cavity 118 of the mobile playing environment 102. Furthermore, the reservoir filling container 106 is nestable with a central portion 120 of the mobile playing environment 102 (as shown in FIG. 1). In this manner, the mobile playing environment 102, the basin 104, and the reservoir filling container 106 can be stored within each other.

Figure 4:
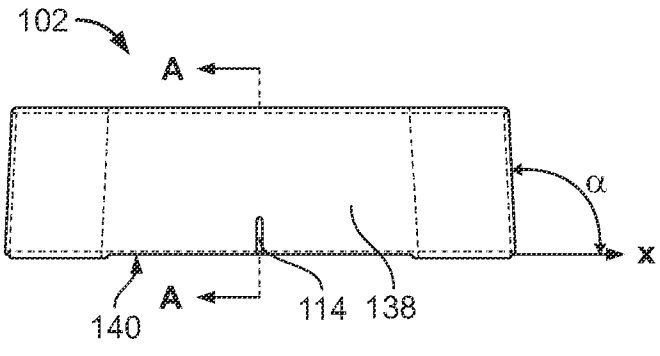
FIG. 4 is a side view of the game board of FIG. 3.
Figure 3:
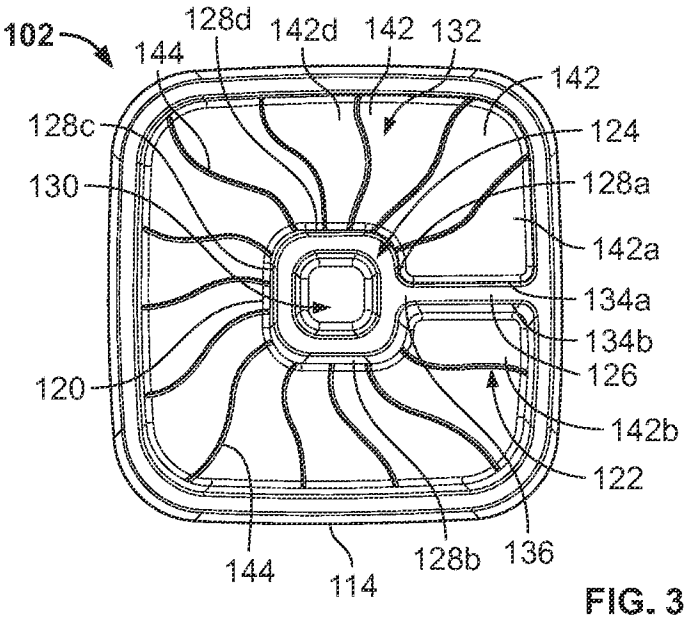
FIG. 3 is a top view of a game board of the multiplayer game of FIG. 1.
Figure 5:
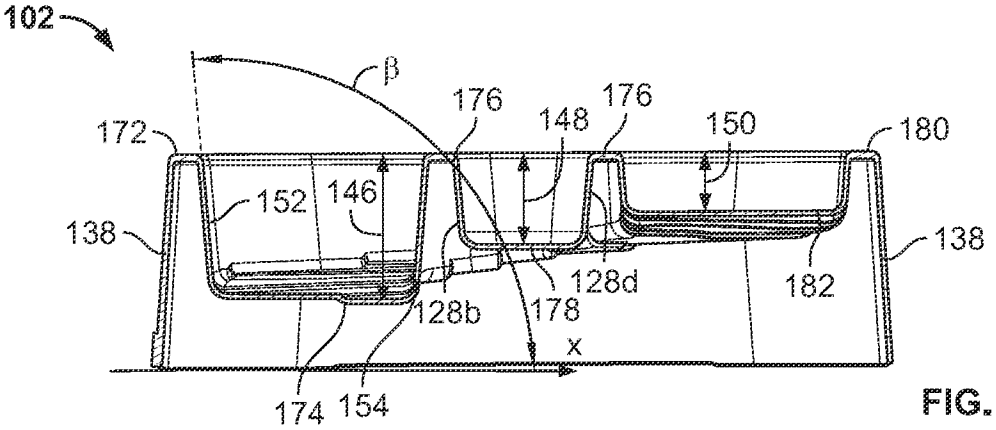
FIG. 5 is a cross-sectional view of the game board taken along the line A-A of FIG. 4.

FIGS. 3, 4, and 5 show top, side, and cross-sectional views, respectively, of the mobile playing environment 102. As shown in FIG. 3, the mobile playing environment defines a central portion 120, a path 132, and a water reservoir 122. The central portion 120 is adapted to hold the reservoir filling container 106 between uses. Accordingly, the central portion 120 is sized to fit the reservoir filling container 106. The central portion 120 defines an interior space 124 adapted to receive the body of the reservoir filling container 106. The interior space 124 is substantially square in shape and defined by first, second, third, and fourth walls 128*a*, 128*c*, 128*d*, 128*e*, which further define an opening 130. The interior space 124 has a depth 148, as shown in FIG. 5. The first wall 128*a* defines a slit 136 that opens into a groove 126 further defined by first and second groove walls 134*a*, 134*b* of the mobile playing environment 102. The groove 126 has a linear shape and is sized to fit the handle of the reservoir filling container 106. When in a storage configuration, the body of the reservoir filling container 106 abuts the interior space 124 of the central portion 120, and the groove 126 abuts the surface of the handle of the reservoir filling container 106.

As shown in FIG. 4, the mobile playing environment 102 is substantially square in shape and is defined by four side walls 138. The one or more alignment features 114 are defined by side walls 138. The alignment features 114 can be projections on the surface of a distal portion of one or more side walls 138. In some embodiments, the alignment features are slits or notches defined on a distal edge 140 of one or more side walls 138. The side walls 138 are angled at an angle alpha ($\alpha$) with respect to the horizontal axis x. The angle alpha typically ranges from about 89 degrees to about 99 degrees (e.g., about 94 degrees).

The path 132 leads down into the water reservoir 122 and includes a series of levels separated by one or more steps 142. A first step 142*a* is partially formed by a surface of the first groove wall 134*a*. The path 132 curves around or spirals down the central portion 120 of the mobile playing environment 102. The path 132 typically has about 10 to 20 steps (e.g., 14 steps) that are partially formed by a surface of one or more of the first, second, third, and fourth walls 128*a*, 128*b*, 128*c*, 128*d* defining the interior space 124 of the central portion 120. Each step 142 has an edge 144 that is wavy or curved (e.g., a curved or wavy nosing) that can improve the aesthetic appearance of the mobile playing environment 102 by simulating an aquatic environment. The steps 42 have about equivalent heights or vertical surfaces (e.g., risers) and equivalent horizontal surfaces (e.g., treads).

The steps 142, the interior surfaces of the four side walls 138, and the exterior surfaces of the first, second, third, and fourth walls 128*a*, 128*b*, 128*c*, 128*d* of the central portion 120 further have a textured surface that can advantageously provide increased resistance that an object (e.g., one or more player tokens) encounters when moving or resting within the mobile playing environment 102 (e.g., when moving a player token from one step 142 to a next step 142), especially when the mobile playing environment 102 is contacted with a fluid such as water.

FIG. 5 illustrates a cross-sectional view of the mobile play environment 102 taken along lines A-A of FIG. 4. The water reservoir 122 is an interior cavity configured to store a liquid (e.g., water). The water reservoir 122 is defined in a space adjacent to groove wall 134*b* such that it is oppositely aligned, across the groove 126, with the first step 142*a* of the path 132. The water reservoir is defined partially by an inner surface 152 of side walls 138 and an inner surface 154 of the second wall 128*b* of the central portion 120. The inner surface 152 is angled at an angle beta (β) with respect to a horizontal axis x. The angle beta can typically range from about 90 degrees to about 100 degrees (e.g., about 95 degrees). In some embodiments, angle beta is about equal to angle alpha.

The water reservoir 122 has an initial depth 146, the central portion has a depth 148, and the fourth step 142*d* has a depth 150. The initial depth 146 extends from a top portion 172 of the side wall 138 and the bottom surface 174 of the water reservoir 122. The depth 148 extends from top portions 176 of the second and fourth walls 128*b*, 128*d* and the surface 178 of the central portion 120. The depth 150 extends from a top portion 180 of the side wall 138 and the surface 182 of the fourth step 142*d*. The depth 150 is less than the depth 148, which is less than the initial depth 146 and the final depth (not shown in FIG. 5) of the water reservoir 122. The final depth of the water reservoir 122 is at the deepest end of the cavity, which corresponds to the area where the fourteenth step 142*n* is located, as shown in FIG. 3. The initial depth 146 of the water reservoir 122 is about 100% greater than the depth 150. The initial depth 146 of the water reservoir 122 is about 50% greater than the depth 148. The final depth of the water reservoir 122 is about 200% greater or more than the depth 150. The final depth of the water reservoir 122 is about 100% greater than the depth 148. The depth 148 of the central portion 120 is about 50% greater than the depth 150. The depth 148 of the central portion 120 is about 50% less than the initial depth 146 of the water reservoir 122.

Figure 7:
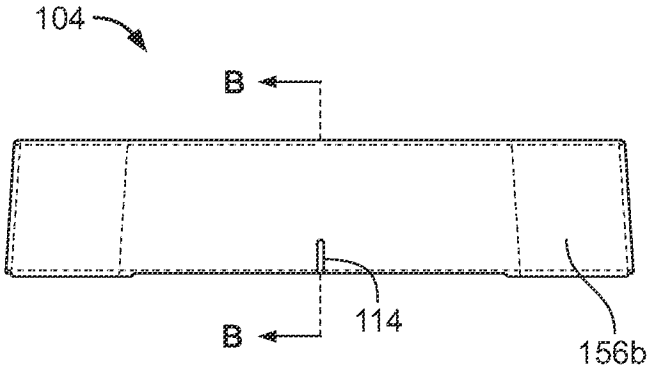
FIG. 7 is a side view of the reservoir filling container of FIG. 6.
Figure 6:
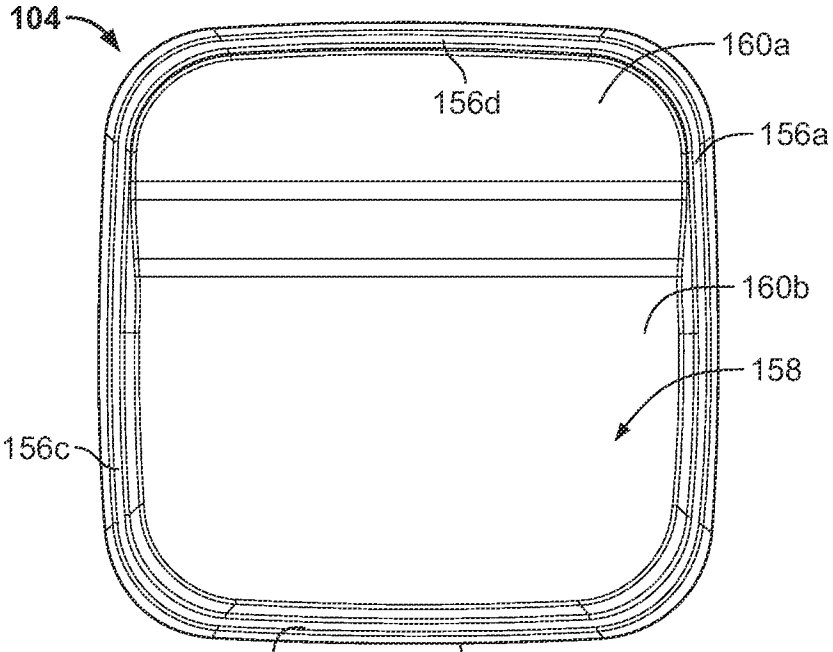
FIG. 6 is a top view of a reservoir filling container of the multiplayer game of FIG. 1.
Figure 8:
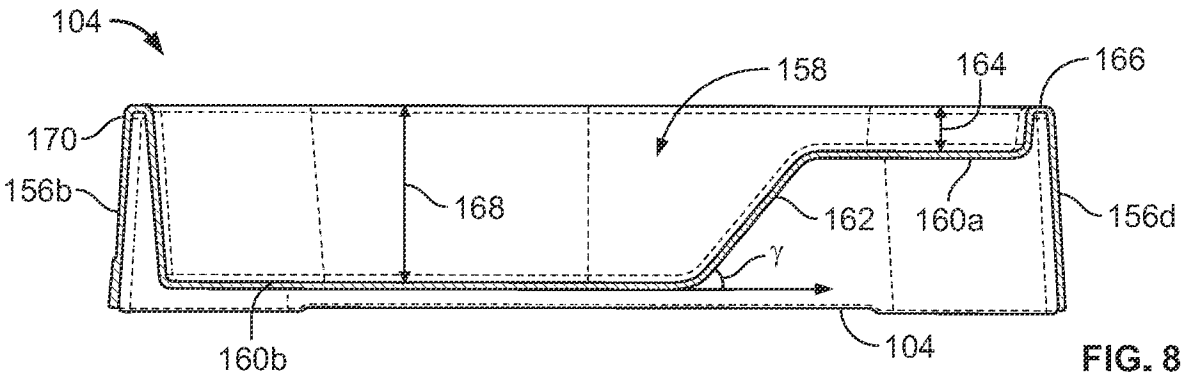
FIG. 8 is a cross-sectional view of the reservoir filling container taken along the line B-B of FIG. 4.

FIGS. 6, 7, and 8 illustrate top, side, and cross-sectional views, respectively, of the basin 104. As shown in FIG. 6, the basin 104 is substantially square in shape and has first, second, third, and fourth side walls 156*a*, 156*b*, 156*c*, 156*d* and a first and second bottom surfaces 160*a*, 160*b* that define a basin reservoir 158. As shown in FIG. 7, the second side walls 156*b* includes alignment features 114 that can be protrusions, slits, or notches, as previously described herein. The fourth side wall 156*d* can also include alignment features 114. In some embodiments, one or more of the first, second, third, and fourth side walls 156*a*, 156*b*, 156*c*, 156*d* can include the alignment features 114. The basin reservoir 158 can be used as a receptacle configured to store or hold a liquid (e.g., water) during play. For example, in some embodiments, a user (e.g., a player) can remove water from the basin reservoir 158 using the reservoir filling container 106 and transfer it to the mobile playing environment 102. The basin reservoir 158 includes an inclined surface 162 that separates the first bottom surface 160*a* from the second bottom surface 160*b*. The inclined surface 162 is angled at an angle gamma (Y) with respect to a horizontal axis x. In some embodiments, the angle gamma is typically about 35 degrees to about 55 degrees (e.g., about 45 degrees).

As shown in FIG. 8, the basin 104 has a first depth 164 extending from the first bottom surface 160*a* to a top portion of the fourth side wall 156*d*. The basin 104 also has a second depth 168 extending from the second bottom surface 160*b* to a top portion of the second side wall 156*b*. The second depth 168 is greater than the first depth 164. In some embodiments, the second depth 168 is about 400% greater or more than the first depth 164. The difference in magnitude of the first and second depths 164, 168 allows the basin 104 to be fitted securely inside an underside cavity of the mobile playing environment 102 when the multiplayer game 100 is in a storage configuration.

Figure 9:
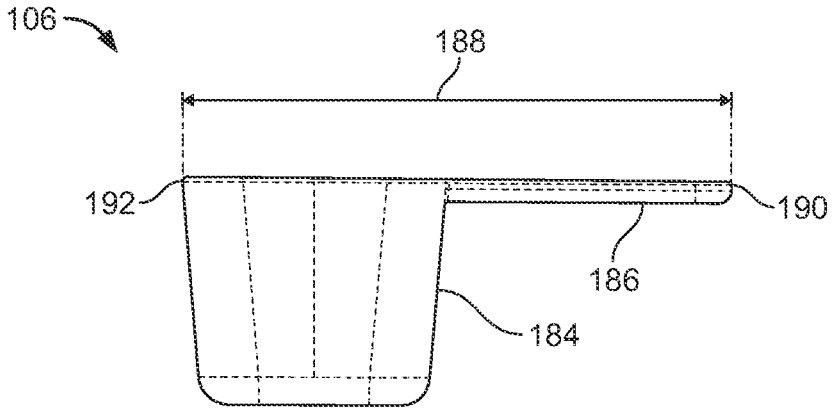
FIG. 9 is a top view of a ladle of the multiplayer game of FIG. 1.
Figure 10:
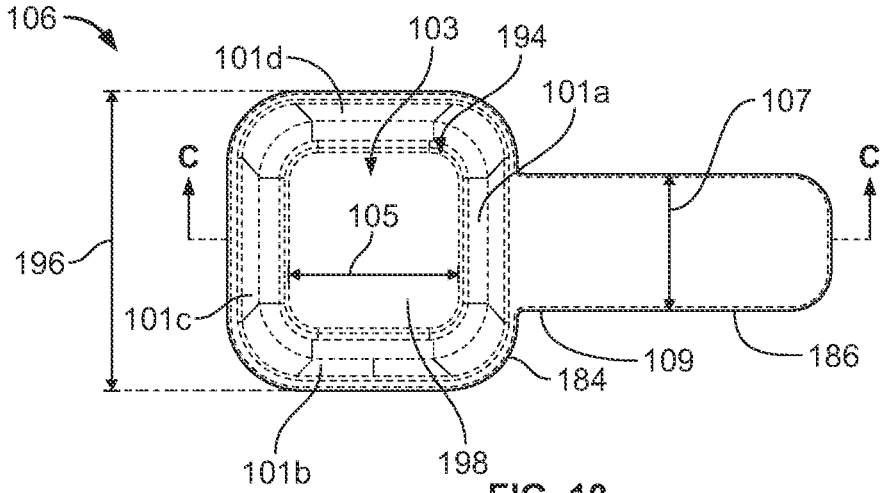
FIG. 10 is a side view of the ladle of FIG. 9.
Figure 11:
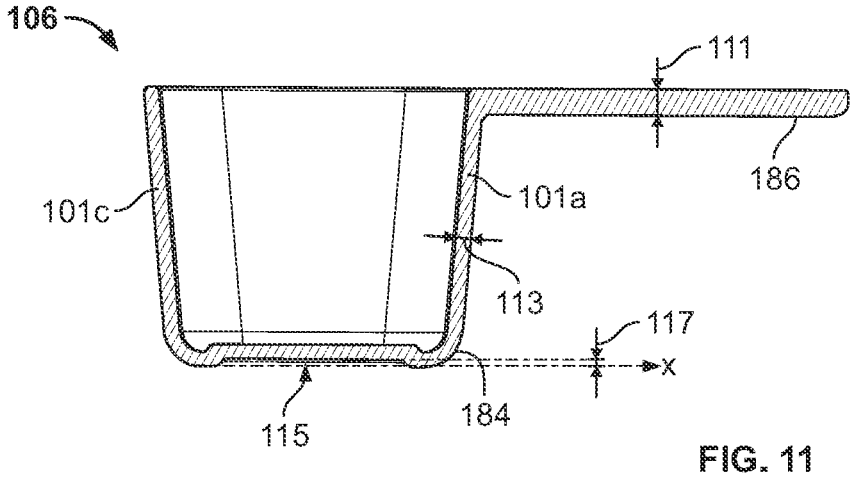
FIG. 11 is a cross-sectional view of the ladle taken along the line C-C of FIG. 10.
Figure 12:
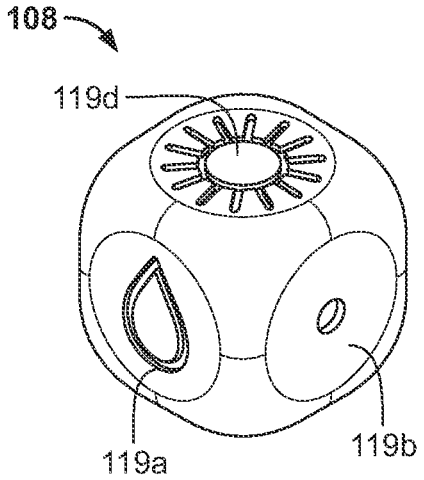
FIG. 12 is a perspective view of a die of the multiplayer game of FIG. 1.
Figure 13:
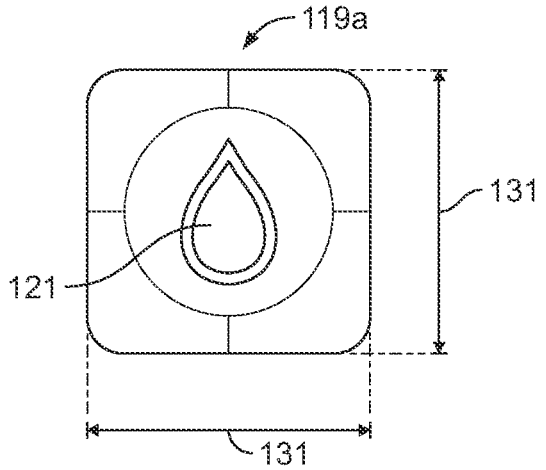
FIGS. 13-17 are side views of the various faces of the die of FIG. 12.
Figure 14:
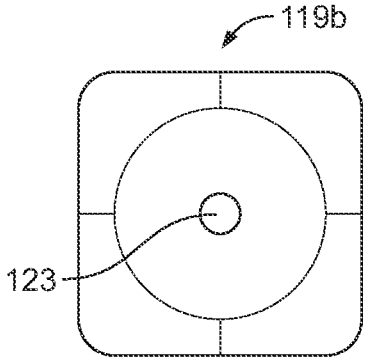
Figure 15:
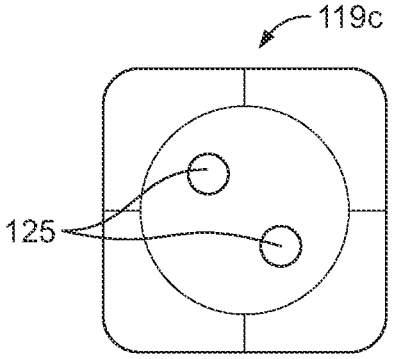
Figure 16:
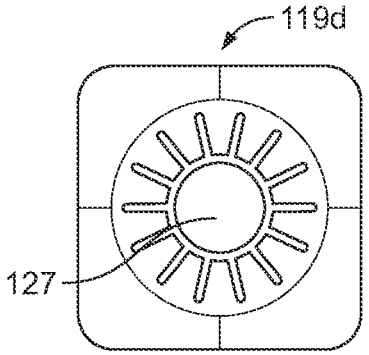
Figure 17:
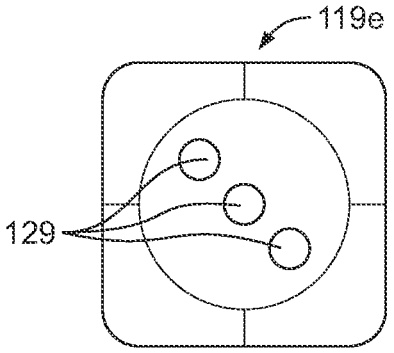

FIGS. 9, 10, and 11 illustrate top, side, and cross-sectional views, respectively, of the reservoir filling container 106. As shown in FIG. 9, the reservoir filling container 106 includes a body 184 and a handle 186. The reservoir filling container 106 has a length 188 extending from a first end 190*a* to a second end 190*b*. As shown in FIG. 10, the body 184 defines an upper opening 194 and includes a bottom surface 198 and first, second, third, and fourth walls 101*a*, 101*c*, 101*d*, 101*e* that further define a cavity 103 having a volume. The upper opening 194 has a first width 196, and the bottom surface 198 has a second width 105. The second width 105 is less than the first with 196 such that the body 184 is tapered. The volume is configured to hold a quantity of water for a player to pour into the water reservoir to increase a level of water within the reservoir and cause the water level to rise along the path. The volume of the reservoir filling container 106 is less than about 3% of a total volume of the water reservoir 122. The body 184 is substantially square in shape and is sized to be received by the interior space of the central portion of the mobile playing environment.

The handle 186 is rigid and extends generally outwardly from the body 184. The first end 190 of the handle 186 is distal from the body 184, and a second end portion 109 of the handle 186 is proximate to the body 184. The handle 186 has a second width 105 that is about 50% less than the first width 196. The handle 186 is structurally interconnected with the first wall 101*a* of the body 184 to provide ease of manipulation of the body 184. The reservoir filling container 106 includes a ladle.

FIG. 11 shows the handle 186 having a thickness 111 that is about equal to or greater than the thickness 113 of the first, second, third, and fourth walls 101*a*, 101*c*, 101*d*, 101*c*. The reservoir filling container 106 has a recessed bottom 115 having a height 117 extending from a horizontal axis x to the external surface of the recessed bottom 115. The recessed bottom 115 can facilitate nesting of the reservoir filling container 106 within the central portion of the mobile playing environment.

Referring to FIGS. 12-17, a movement instructor 108 having six faces (i.e., a multi-faced die) is provided. First, second, third, fourth, and fifth faces 119*a*, 119*b*, 119*c*, 119*d*, 119*e* are shown, and each face is marked with a marking to indicate movement instructions. For example, the first face 119*a* includes a droplet marking 121, the second face 119*b* includes a first pip 123 denoting the number one, the third face 119*c* includes second pips 125 denoting the number two, the fourth face 119*d* includes a sun marking 127, and the fifth face 119*e* includes third pips 129 denoting the number three. The sixth face is identical to the first face 119*a*, and thus, indicates the same movement instruction as the first face 119*a*. The movement instructor 108 can be a die. The movement instructions has equivalent side lengths 131 and thus, is cubical in shape. The movement instructor 108 also features rounded corners.

The movement instructor 108 is manipulable by a player to generate an unselected movement instruction from a limited set of possible instructions including moving a token downward along the path and adding water to the water reservoir. The player tokens are movable to and between various positions along the path. For example, the limited set of possible instructions includes different numbers of steps for a player to move a token down the path. The droplet marking 121 of the first face 119*a* indicates that a player is to add water to the water reservoir. The first pip 123 of the second face 119*b* indicates that a player is to move their player token along the path for one step. The second pips 125 of the third face 119*c* indicate that a player is to move a token along the path for two steps. The sun marking 127 of the fourth face 119*d* indicates that a player is to manipulate a game termination indicator as disclosed elsewhere herein. The third pips 129 of the fifth face 119*e* indicate that a player is to move their player token along the path for three steps.

Figure 18:
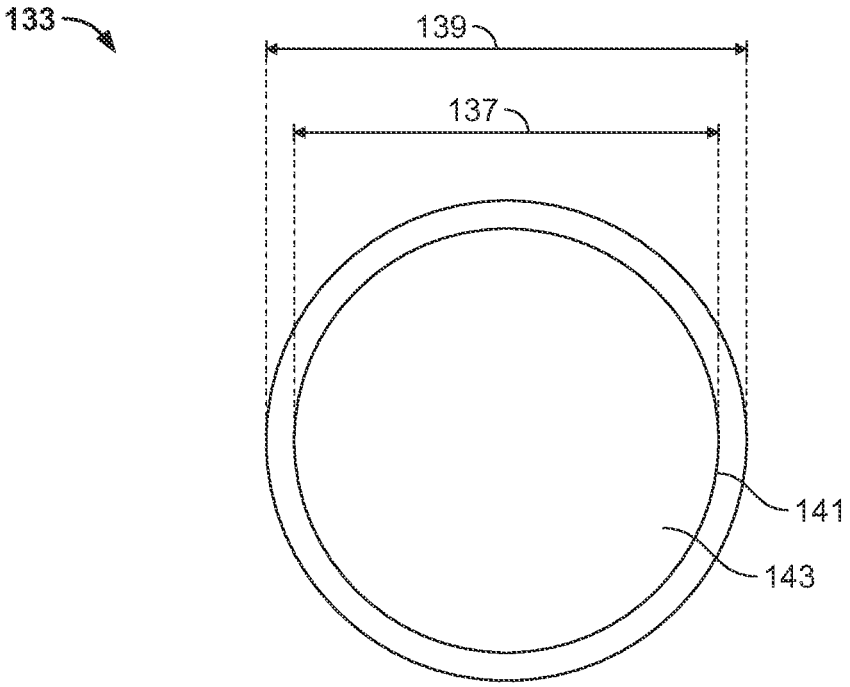
FIG. 18 is a top view of a base of a game termination indicator of the multiplayer game of FIG. 1.
Figure 19:
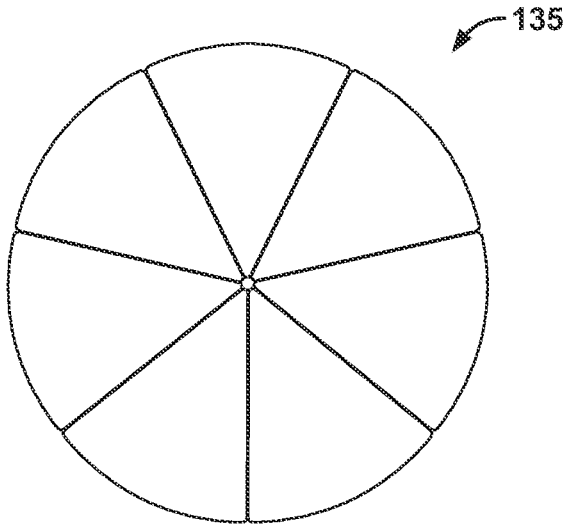
FIG. 19 is a top view of game-end segments of the game termination indicator of the multiplayer game of FIG. 1.
Figure 20:
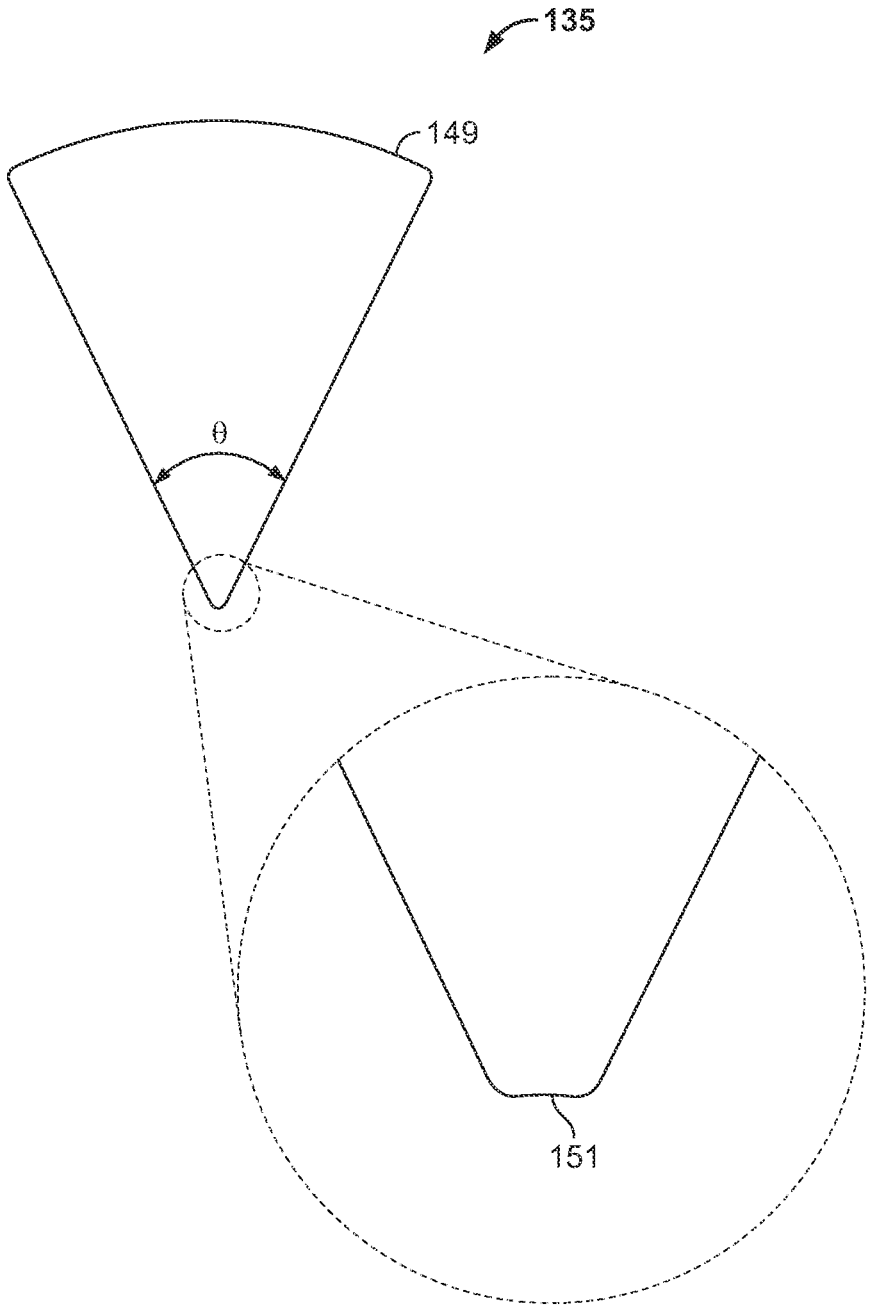
FIG. 20 is a magnified view of a game-end segment of FIG. 19.

Referring to FIGS. 18, 19, and 20, a game termination indicator 133 and game-end segments 135 are provided. The game termination indicator 133 is a circular board or base having an inner diameter 137 that is less than an outer diameter 139. The circular board or base of the game termination indicator 133 is configured to receive the game-end segments 135. The game-end segments 135 include wedge segments that together form a circle. The game-end segments 135 are seven circular sectors having square ends 151 and arc length edges 149 that are configured to align with an inner circumferential edge 141 of the game termination indicator 133 when placed on an upper surface 143 of the game termination indicator 133. Each game-end segment 135 has a central angle theta (0) that is about 51.4 degrees.

The game termination indicator 133 includes a discrete number of game-end segments 135 that together indicate an end of play when manipulated. The limited set of possible instructions of the multiplayer game includes manipulating a game-end segment 135 or a next game-end segment 135. For example, the limited set of possible instructions include moving a game-end segment 135 to the circular base of the game termination indicator 133. Furthermore, the limited set of possible instructions includes game play instructions indicating that a player may move any one of the player tokens in response to the movement instructor generating an instruction to move a token downward along the path To set up the multiplayer game, the players may switch the game from a stored configuration (e.g., nested configuration) to a play configuration by separating the mobile playing environment from the basin. Next, the players may fill the basin with water and set it next to the mobile playing environment with the reservoir filling container The game-end segments may be placed separately from the game termination indicator such that there are no game-end segments resting on the surface of the game termination indicator. Next, the players place all the tokens on the first step of the path. Any number of tokens and any number of players (e.g., one or more) may be acceptable. The objective of the game is to have all tokens floating in water before all the game-end segments are placed on the surface of the game termination indicator. The game further encourages to reach this goal in a cooperative manner. For example, the players collectively decide which token may be moved if a movement instruction instructs so. The players use the movement instructor indicator to generate unselected movement instructions from the limited set of possible instructions.

Figure 21:
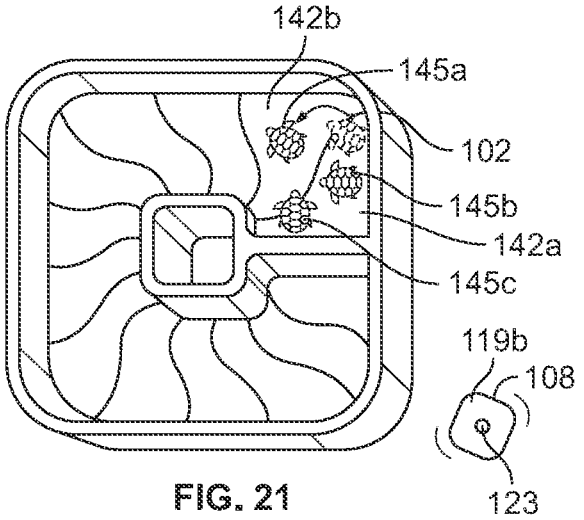
FIGS. 21-25 are schematics illustrating example methods of play with the multiplayer game of FIG. 1.
Figure 22:
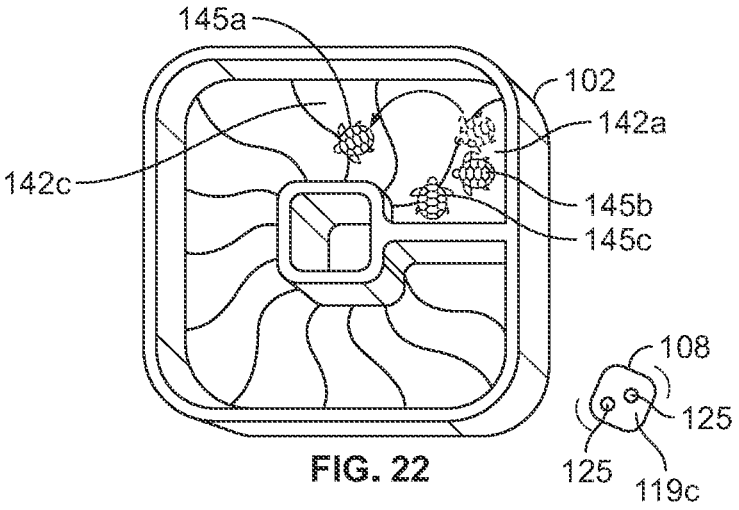
Figure 23:
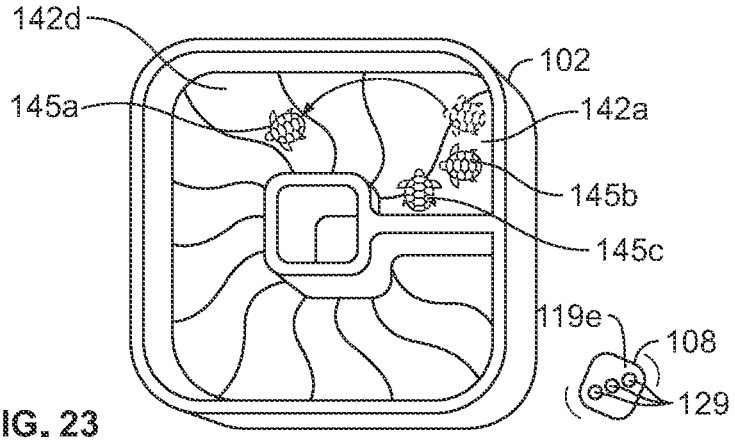

FIGS. 21-25 illustrate each of these movement instructions from the limited set of possible instructions. FIG. 21 illustrates the movement of the first token 145*a* (e.g., a turtle) when the player rolls the movement instructor 108, and it lands with the second face 119*b* facing up. The second face 119*b* features the first pip 123, thereby indicating the movement instruction of moving any one of the first, second, or third tokens 145*a*, 145*b*, 145*c* down one step (e.g., down from the first step 142*a* to the second step 142*b*). The first token 145*a* is illustrated as being moved from the first step 142*a* to the second step 142*b* in FIG. 21. FIG. 22 illustrates the movement of the first token 145*a* when the player rolls the movement instructor 108, and it lands with the third face 119*c* facing up. The third face 119*c* features the second pips 125, thereby indicating the movement instruction of moving any one of the first, second, or third tokens 145*a*, 145*b*, 145*c* down two steps (e.g., down from the first step 142*a* to the third step 142*c*). The first token 145*a* is illustrated as being moved from the first step 142*a* to the third step 142*c* in FIG. 22. FIG. 23 illustrates the movement of the first token 145*a* when the player rolls the movement instructor 108, and it lands with the fifth face 119*e* facing up. The fifth face 119*e* features the third pips 129, thereby indicating the movement instruction of moving any one of the first, second, or third tokens 145*a*, 145*b*, 145*c* down three steps (e.g., down from the first step 142*a* to the fourth step 142*d*). The first token 145*a* is illustrated as being moved from the first step 142*a* to the fourth step 142*d* in FIG. 23. The first, second, or third tokens 145*a*, 145*b*, 145*c* are configured to float in water.

Figure 24:
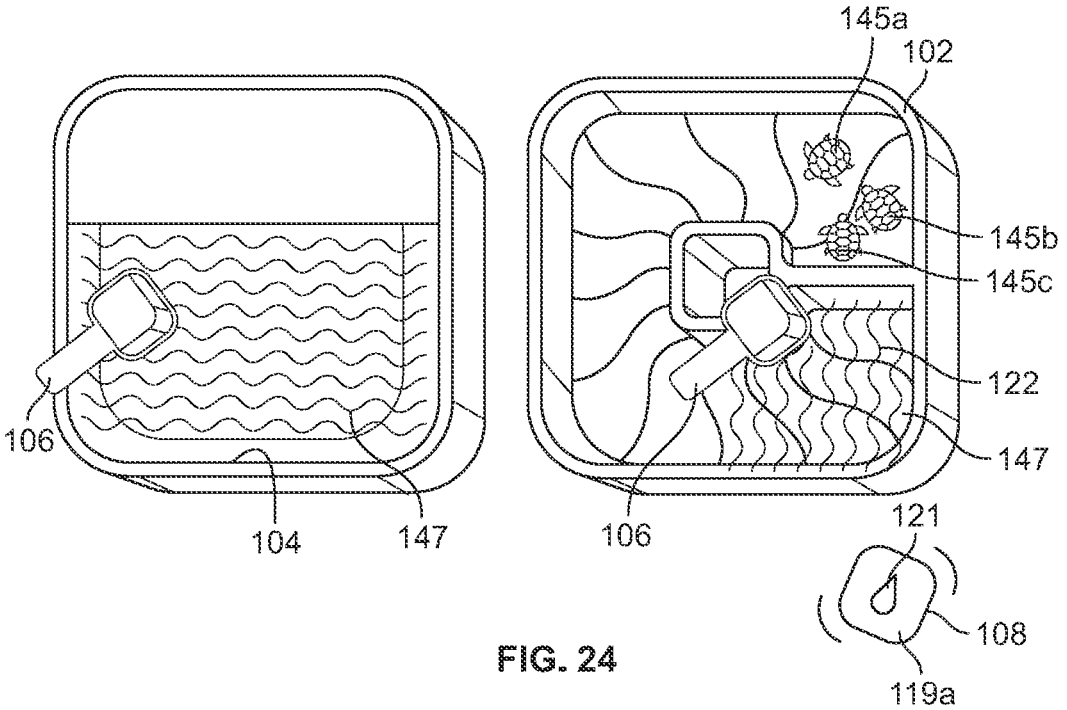

FIG. 24 illustrates the action of the player when the player rolls the movement instructor 108, and it lands with the first face 119*a* facing up. The first face 119*a* features the droplet marking 121, thereby indicating the movement instruction of adding water 147 to the mobile playing environment 102. The player may remove water 147 from the basin 104 using the reservoir filling container 106 and may transfer the water 147 to the water reservoir 122 of the mobile playing environment 102. The first, second, or third tokens 145*a*, 145*b*, 145*c* may not be moved according to this movement instruction.

Figure 25:
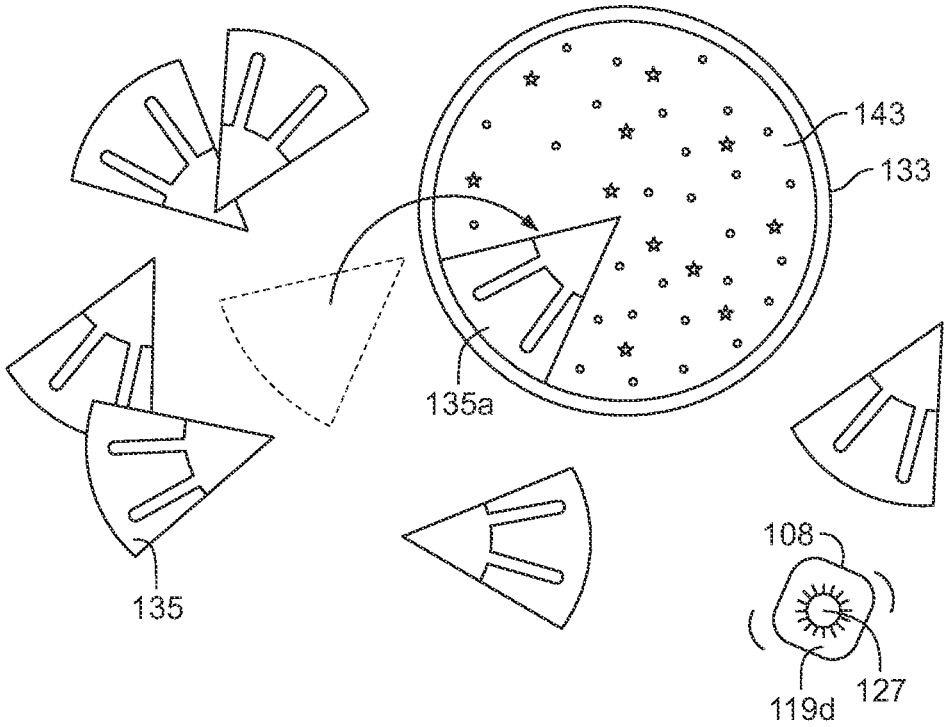

FIG. 25 illustrates the action of the player when the player rolls the movement instructor 108, and it lands with the fourth face 119*d* facing up. The fourth face 119*d* features the sun marking 127, thereby indicating the movement instruction of manipulating a first game-end segment 135*a*. The player may place a game-end segment 135 onto the upper surface 143 of the game termination indicator 133. The first game-end segment 135*a* is illustrated as being placed on the upper surface 143 of the game termination indicator 133 in the example shown in FIG. 25. The first, second, or third tokens may not be moved according to this movement instruction.

While the above-discussed multiplayer game 100 has been described and illustrated as with respect to certain dimensions, shapes, arrangements, configurations, and material formulations, and with respect to certain methods, in some embodiments, a game that is otherwise substantially similar in construction and function to the multiplayer game 100 may include one or more dimensions, shapes, arrangements, configurations, and/or materials formulations that are different from the ones discussed above or may be used with respect to methods that are modified as compared to the methods described above. For example, while the set of multiplayer game 100 has been described and illustrated as including alignment features 114, a game that is otherwise substantially similar in construction and function to the multiplayer game 100 may alternatively include alignment features 114 that are markings or raised portions on the surface of the side walls of the basin 104 and/or the mobile playing environment 102. In some embodiments, the game that is otherwise substantially similar in construction and function to the multiplayer game 100 may alternatively include one or more alignment features that are manually or mechanically marked on one or more of the side walls of the mobile playing environment 102 and/or the basin 104. For example, one or more alignment features can be mechanically scribed (e.g., etched or printed) on one or more of the side walls of the mobile playing environment 102 and/or the basin 104. In another example, one or more alignment features can be manually labeled (e.g., by using an adhesive label, ink, or the like) on one or more of the side walls of the mobile playing environment 102 and/or the basin 104.

While the multiplayer game 100 has been described and illustrated as including a movement instructor 108 that includes a die, in some embodiments, a game that is otherwise substantially similar in construction and function to the multiplayer game 100 may include a movement instructor that includes a spinner having motion segments marked to indicate movement instructions. In another example, a game that is otherwise substantially similar in construction and function to the multiplayer game 100 may include a movement instructor that includes cards having markings that indicate unselected movement instructions.

While the multiplayer game 100 has been described and illustrated as including a movement instructor 108 having six faces, where at least two faces indicate the same movement instruction, in some embodiments, a game that is otherwise substantially similar in construction and function to the multiplayer game 100 may include more than one movement instructors (e.g., two, three, or more movement instructors). In another example, a game that is otherwise substantially similar in construction and function to the multiplayer game 100 may include one or more movement instructors that have less than six faces (e.g., a tetrahedral dice having 4 faces) and/or more than six faces (e.g., polyhedral dice having 8, 10, 12, or 20 faces). In another example, a game that is otherwise substantially similar in construction and function to the multiplayer game 100 may include a movement instructor where at least three or more faces indicate the same movement instruction. In another example, a game that is otherwise substantially similar in construction and function to the multiplayer game 100 may include a movement instructor where the same movement instruction indicated by at least two die faces is adding a game-end segment to the game termination indicator or moving a token along the path for one, two, or three steps.

While the multiplayer game 100 has been described and illustrated as including tokens 145 in the shape of a turtle, in some embodiments, a game that is otherwise substantially similar in construction and function to the multiplayer game 100 may include tokens having any suitable shape (e.g., an animal shape, a geometric shape, or the like).

While the multiplayer game 100 has been described and illustrated as including steps 142 having an edge 144 that is wavy or curved (e.g., a curved or wavy nosing), in some embodiments, a game that is otherwise substantially similar in construction and function to the multiplayer game 100 may include steps having straight edges.

While a number of examples have been described for illustration purposes, the foregoing description is not intended to limit the scope of the invention, which is defined by the scope of the appended claims. There are and will be other examples and modifications within the scope of the following claims.

What is claimed is:

1. A multiplayer game, comprising:

a mobile playing environment defining a water reservoir and a path winding down into the reservoir;

a reservoir filling container defining a volume configured to hold a quantity of water for a player to pour into the reservoir to increase a level of water within the reservoir and cause the water level to rise along the path;

player tokens movable to and between various positions along the path; and a movement instructor comprising one or more of a die, a spinner, and cards, the movement instructor being manipulable by a player to generate an unselected movement instruction from a limited set of possible instructions comprising moving a token downward along the path and adding water to the reservoir.

2. The multiplayer game of claim 1, wherein the movement instructor comprises a spinner having motion segments marked to indicate movement instructions.

3. The multiplayer game of claim 1, wherein the volume of the reservoir filling container is less than 3% of a total volume of the reservoir.

4. The multiplayer game of claim 1, wherein the reservoir filling container comprises a ladle.

5. The multiplayer game of claim 1, wherein the path comprises a series of levels separated by steps.

6. The multiplayer game of claim 5, wherein the limited set of possible instructions includes different numbers of steps for a player to move a token down the path.

7. The multiplayer game of claim 1, wherein the path curves around a central portion of the mobile playing environment.

8. The multiplayer game of claim 7, wherein the central portion is adapted to hold the reservoir filling container between uses.

9. The multiplayer game of claim 1, further comprising a basin defining a basin reservoir configured to hold water for the player to remove with the reservoir filling container.

10. The multiplayer game of claim 9, wherein the basin and the mobile playing environment are nestable and comprise one or more visible features configured to confirm alignment between the basin and the mobile playing environment.

11. The multiplayer game of claim 1, wherein the movement instructor comprises a multi-faced die, with faces of the die marked to indicate movement instructions.

12. The multiplayer game of claim 11, wherein at least one die face indicates that a player is to add water to the reservoir, and at least one other die face indicates that a player is to move a token along the path.

13. The multiplayer game of claim 11, wherein at least two die faces indicate the same movement instruction.

14. The multiplayer game of claim 1, further comprising a game termination indicator comprising a discrete number of game-end segments that together indicate an end of play when manipulated.

15. The multiplayer game of claim 14, wherein the limited set of possible instructions includes manipulating a next game-end segment.

16. The multiplayer game of claim 14, wherein the game-end segments comprise wedge segments that together form a circle.

17. The multiplayer game of claim 14, wherein the game termination indicator comprises a circular base that is configured to receive the game-end segments.

18. The multiplayer game of claim 17, wherein the limited set of possible instructions comprise moving a game-end segment to the circular base.

19. A multiplayer game, comprising:

a mobile playing environment defining a water reservoir and a path winding down into the water reservoir;

a reservoir filling container defining a volume configured to hold a quantity of water for a player to pour into the water reservoir to increase a level of water within the water reservoir and cause the water level to rise along the path;

player tokens movable to and between various positions along the path;

a movement instructor comprising one or more of a die, a spinner, and cards, the movement instructor being manipulable by a player to generate an unselected movement instruction from a limited set of possible instructions comprising moving a token downward along the path and adding water to the water reservoir; and a basin defining a basin reservoir configured to hold water for the player to remove with the reservoir filling container, wherein the basin and the mobile playing environment are nestable and comprise one or more visible features configured to confirm alignment between the basin and the mobile playing environment.

* * * * *